United States Patent [19]

Widmer

[11] 4,314,695

[45] Feb. 9, 1982

[54] COOLING ELEMENTS FOR FURNACES

[75] Inventor: Colin F. Widmer, Middlesbrough, England

[73] Assignee: James Brown & Sons, Middlesbrough, England

[21] Appl. No.: 110,225

[22] Filed: Jan. 7, 1980

[30] Foreign Application Priority Data

Jan. 17, 1979 [GB] United Kingdom ..... 01721/79

[51] Int. Cl.[3] ..... F27B 1/24

[52] U.S. Cl. ..... 266/194; 122/6 B

[58] Field of Search ..... 266/241, 193, 194; 122/6 B, 6 A

[56] References Cited

U.S. PATENT DOCUMENTS 3,185,465 5/1965 Patton ..... 266/194
4,023,782 5/1977 Eifer ..... 266/186

FOREIGN PATENT DOCUMENTS 635629 9/1936 Fed. Rep. of Germany .
2743380 6/1978 Fed. Rep. of Germany .
2803297 1/26/78 Fed. Rep. of Germany .. 266/194
2160724 7/1973 France .
2341650 9/1977 France .
45-32324 10/1970 Japan ..... 266/193

OTHER PUBLICATIONS

Slayley et al. *Blast Furnace and Steel Plant* April 1965 pp 303–310

*Primary Examiner*—M. J. Andrews

[57] ABSTRACT

A cooling means for a furnace, particularly a blast furnace, is mounted to the furnace by means of a bellows, the rear end of which is attached to a collar surrounding one or more of the conduits for cooling water and the front end of which is adapted for attachment to the furnace shell or a member rigid therewith. In this way the cooling element is firmly and sealingly mounted in the furnace shell, the bellows allowing movement of the element with respect to the shell caused by settling of refractory material in which the cooling element is located.

8 Claims, 4 Drawing Figures

COOLING ELEMENTS FOR FURNACES

FIELD OF THE INVENTION

This invention relates to cooling elements for furnaces which are mainly made from copper or copper alloy and to the provision of such element which is particularly adapted for fixing to steel elements on the outside of the furnace shell or direct to the shell.

Cooling elements for a blast furnace consist of a body through which water can be circulated, the main part of the body being embedded in the furnace lining whilst the rear end is adapted to take water supply and outlet pipes and is often attached to the outside of the furnace shell.

BACKGROUND OF THE INVENTION

Whilst it is known that copper coolers have been constructed with steel attachments which can subsequently be welded to the furnace shell or steel elements mounted thereon, these coolers cannot move to allow for expansion and contraction of the furnace shell or refractories. Likewise it is known to use coolers with flanges which are bolted to the furnace shell or steel elements mounted thereon, in such a manner as to allow the coolers to move slightly to accommodate relative movement between the shell of the furnace and the refractories in which the coolers are set. Whilst the coolers which can be attached to the furnace by welding have the advantage of ensuring gas tightness and add to the strength of the furnace additional cost and complication of the refractory lining is necessary to avoid the relative movement between the shell and the refractories due to expansion and contraction.

SUMMARY OF THE INVENTION

In accordance with the present invention a cooling element for a furnace having inlet and outlet conduits for cooling fluid and means for attaching the element to the shell of a furnace is characterised in that the attaching means comprises at least one bellows, the rear end of which is attached (preferably by welding) to an outwardly extending collar surrounding a conduit and the forward end of which is attached to an element which can be secured to the furnace shell or a member rigid therewith.

In a preferred form of the invention the inlet and outlet conduits of the cooler pass through a single flange (preferably a circular flange) on the body of the cooler, and a single bellows is used, which surrounds the inlet and outlet conduits. This single flange may be offset to the side of the cooler, the inlet conduit leading directly to a conduit passing round the nose of the cooler.

On coolers which incorporate two separate water circulation systems, known as duplex coolers, or where pipe connections are not close enough together so that both conduits pass through one bellows, the bellows connection may be duplicated. In the case of duplex coolers the four conduits may be grouped together in pairs. Thus where the element has a forward cooling compartment with inet and outlet conduits separate from the inlet and outlet conduits for the main compartment of the cooler, the four inlet and outlet conduits may be grouped into two pairs, one adjacent each end of the cooler, each pair passing through a respective common flange on the body of the cooler, there being two bellows, one for each said common flange.

In a preferred form of the invention the outwardly extending collar to which the rear end of the bellows is attached is located round the rear end of a tube attached at its forward end to the flange on the body of the cooler through which the conduit passes or conduits pass. In an alternative form of the invention the collar may be cast as an integral part of the cooler.

The element attached to the forward end of the bellows may be a short steel tube, and this may be secured in turn to an outwardly extending flange at any angle which suits the furnace shell. When this outwardly extending flange is in turn welded to the furnace shell or to a retaining plate or other member on the furnace shell with the cooler packed in the refractory lining, the cooler can move with this lining, but is at the same time gas-tightly connected to the furnace shell, the bellows accommodating any movement between the cooler and the said outwardly extending flange.

Where there is a danger of the cooler being dragged into the furnace when the refractory lining wears, a projection may be incorporated which makes the rear end of the cooler larger than the hole through which the cooler passes, thus preventing the cooler from being drawn into the body of the furnace.

In another aspect of the invention a cooling element having inlet and outlet conduits for cooling fluid and means for attaching the element to a furnace wall is characterised in that the inlet and outlet conduits lead through circular flanges (and preferably through a single such flange) on the body of the cooler. Then the flange or flanges act as locations to attach the element to the furnace shell. Such a cooling element may be used as a replacement for any cooling element fitted with bellows which may be withdrawn from service after use, and besides acting as a replacement cooling element, is valuable in itself as a cooling element for incorporation into a furnace on the lining or re-lining thereof.

The use of a single such flange is particulary advantageous, as it serves as a single location for the attachment of the element to the furnace shell. Such a cooling element may have a steel tube welded round the said single flange and in a preferred embodiment an outwardly extending flange is welded to the steel tube.

BRIEF DESCRIPTION OF DRAWINGS

Various forms of the invention will now be described with reference to the accompanying drawings, wherein.

DESCRIPTION OF PREFERRED EMBODIMENTS

Figure 1:
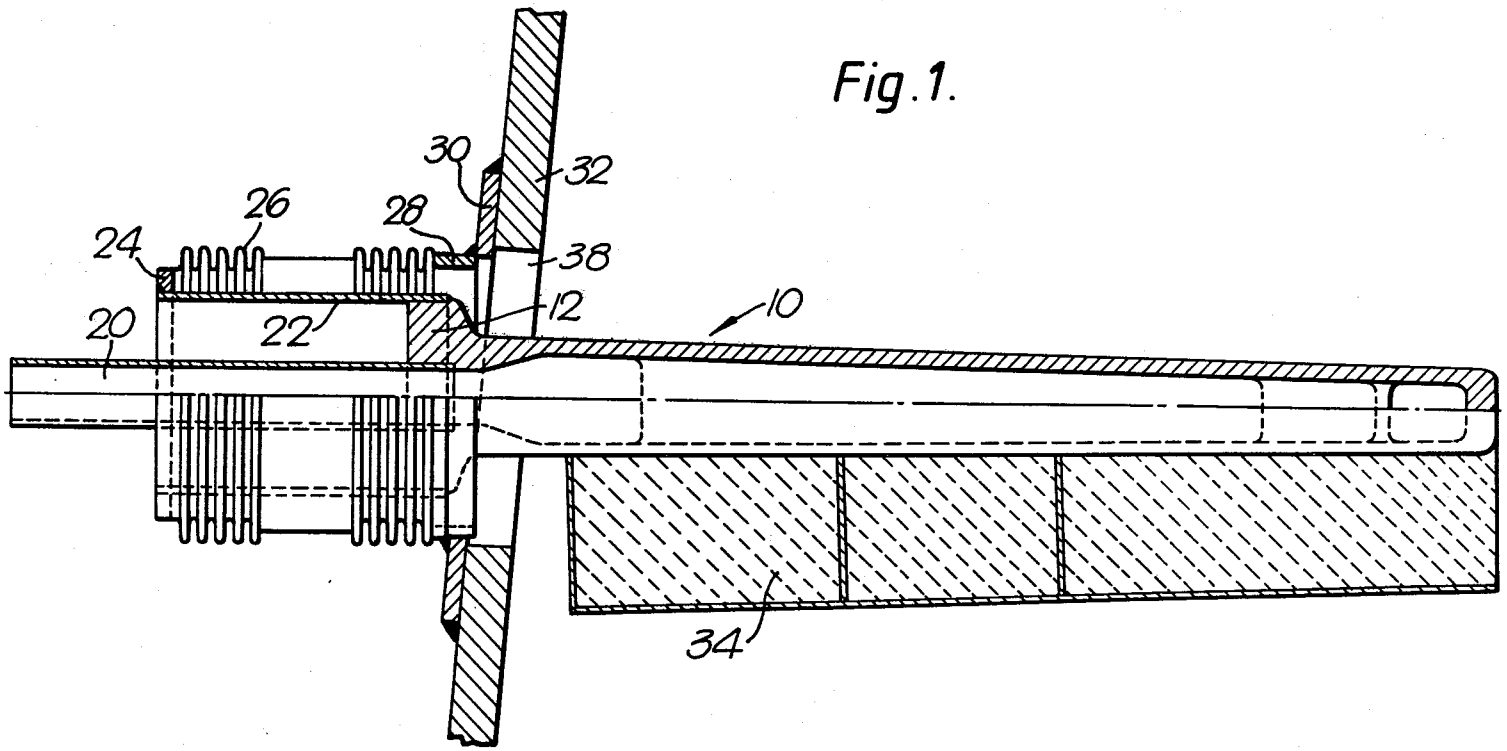
FIG. 1 shows a cast copper cooler half in section mounted through the shell of a blast furnace.
Figure 2:
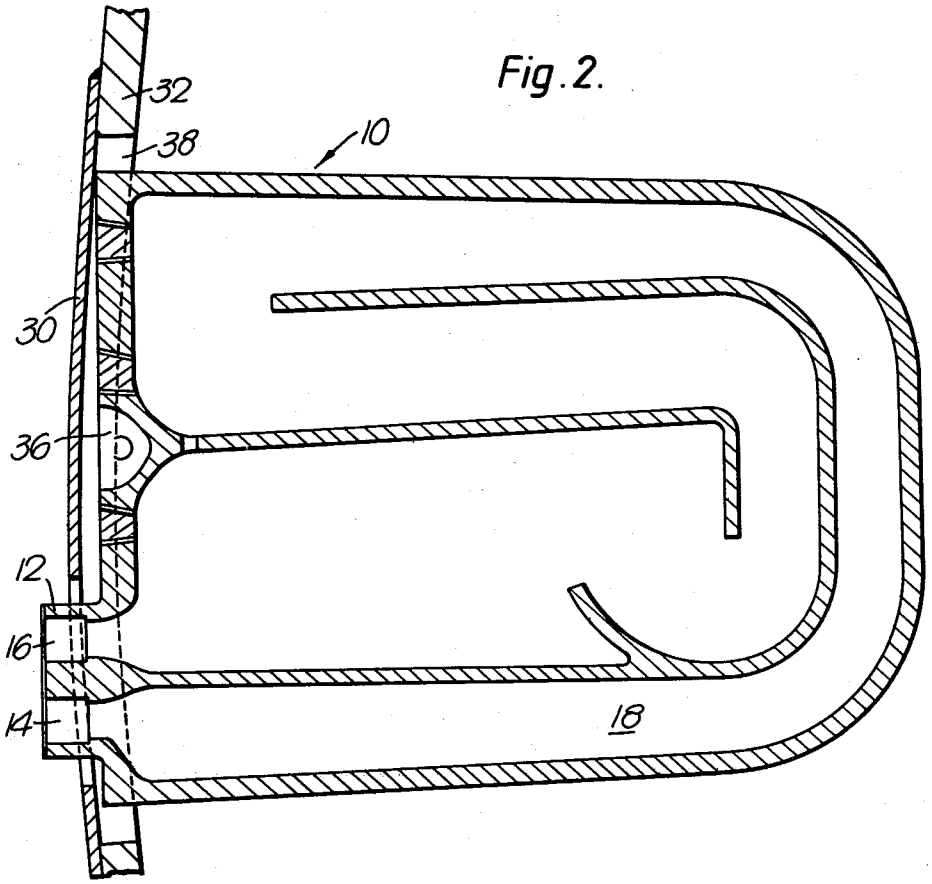
FIG. 2 is a sectional plan view of the cooler of FIG. 1 without the flexible connection to the furnace shell.

Referring first to FIGS. 1 and 2, the cooling element 10 is cast from copper or copper alloy and includes at one end of the rear of the cooler a cast circular flange 12 in which is located a water inlet 14 and a water outlet 16. Partitions cast within the body of the cooler provide a conduit 18 leading round the nose of the cooler and extending rearwardly to form a tortuous passage leading to the outlet 16. Water pipes 20, of which one can be seen in FIG. 1, form conduits which lead water to the inlet 14 and away from the outlet 16.

Attached to the circular flange 12 and extending rearwardly therefrom is a steel tube 22, to the rear end of which is welded an outwardly extending collar 24. Welded to the periphery of the collar 24 is the rear end of a bellows 26 generally cylindrical in shape, made of stainless steel, to the forward end of which is welded a steel tube 28. To the tube 28 is welded an outwardly extending flange 30 at an angle which suits the angle of the furnace shell 32 at that point.

FIG. 1 shows the cooling element 10 located in position on refractory 34, having been inserted through a hole 38 in the furnace shell. In use the refractory would be located both above and below the cooling element and any mutual movement between the refractory and the steel shell of the furnace would cause relative movement between the cooling element 10 and the furnace shell which would be taken up by the bellows.

The normal lifting and pulling connection on the cooling element 10, instead of being a lug or lugs protruding from the rear end of the cooling element (which is the usual form) in this case takes the form of a pocket 36 with holes through the top and bottom walls to accommodate an attachment pin.

Figure 3:
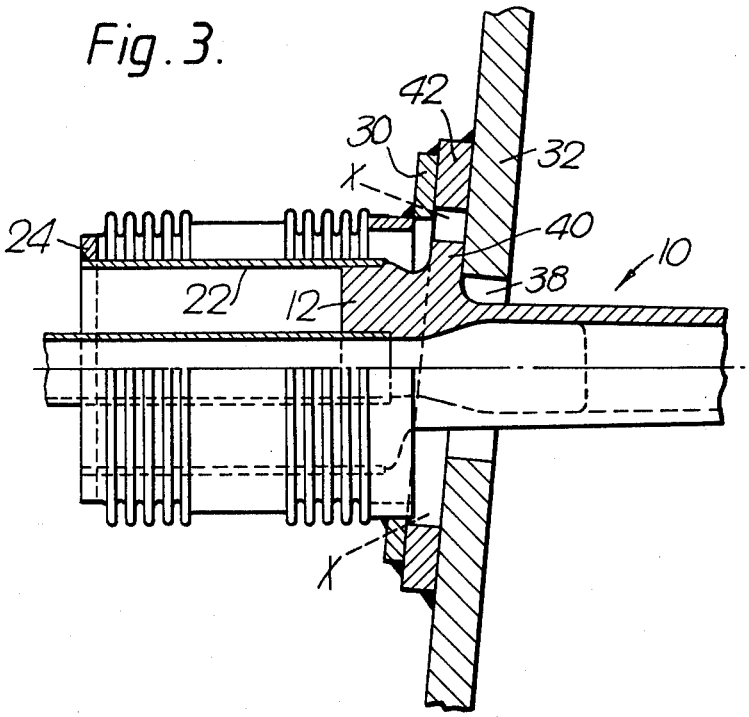
FIG. 3 is a part sectional view similar to FIG. 1 but showing a cooler with a projection to prevent it being drawn into the furnace, and a slightly different mounting.
Figure 4:
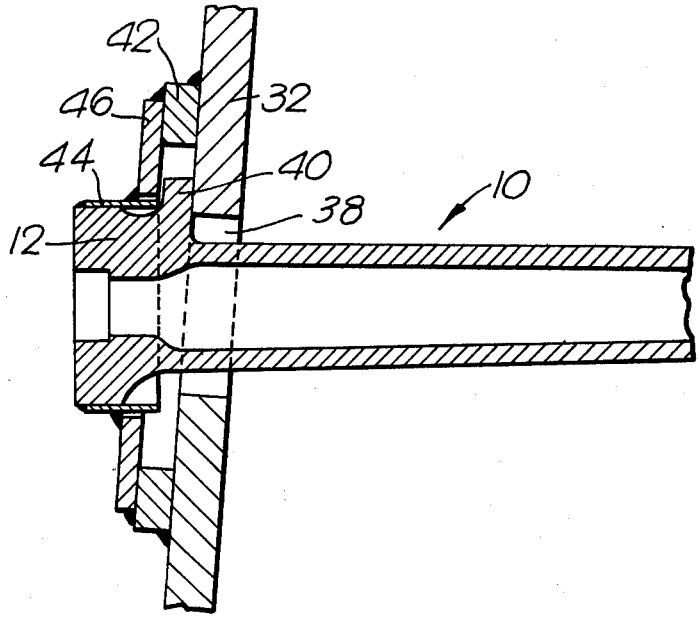
FIG. 4 is a sectional elevation of a cooler without a bellows which can be used as a replacement for the cooler of FIG. 3.

In FIGS. 3 and 4 like parts to those of the embodiment shown in FIGS. 1 and 2 are given the same reference numeral. The essential difference between the cooling element 10 shown in FIG. 3 and that shown in FIGS. 1 and 2 is the provision of a projection 40 extending the whole width of the cooler which is cast above the cooler and which is of such a size that the rear end of the cooler including this projection is larger than the vertical dimension of the hole 38 through which the front of the cooler is passed into the furnace. The outwardly extending flange 30, instead of being welded direct to the furnace shell 32 is welded to a retaining plate 42 which is itself welded to the furnace shell.

If the cooling element 10 fails during use, it can be removed by cutting the flange 30 at the point marked X in FIG. 3 of the drawings.

With the cooling element either of FIGS. 1 and 2 or of FIG. 3 the collar 24, instead of being located on a steel tube 22, could be cast as an integral part of the cooler, the flange 12 being extended rearwardly to a sufficient extent.

The cooling element shown in FIG. 4 may be used as a replacement cooling element if a faulty element such as that shown in FIG. 3 is removed. As can be seen the cast cooling element 10 is exactly the same as that shown in FIG. 3. The steel tube 22 in this instance becomes a shorter steel tube 44 which extends a short distance forwardly from the end of the flange 12, but its position will depend on the position of the flange 12 in relation to the shell of the furnace. Thus, if the cooling element, including the flange 12, were located within the shell 32 of the furnace, the tube 44 would extend rearwardly. An outwardly extending flange 46 having an aperture which embraces the tube 44 is welded to the tube 44. This can be welded to the plate 42 or the remnants of the flange 30 of a previous cooling element 10 (such as that shown in FIG. 3) which has been removed by cutting at X as previously indicated. The ue of a cooling element which is not flexibly mounted is entirely satisfactory as a replacement cooler, because by this time the refractory will have settled down and is not likely to shift appreciably in relation to the furnace shell.

A cooling element such as that shown in FIG. 4 where the inlet and outlet conduits lead through a flange or flanges on the body of the cooler may also be used very satisfactorily as a rather cheaper design of cooler for both initial fitting and replacement in a furnace, where flexibility of the cooler mounting is not deemed to be essential. The flange 12 serves as a location for attachment of the whole cooling element to the furnace shell and results in a simple and cheap design of cooler.

An additional feature which may be applied to the flexibly mounted coolers when considerable movement is anticipated is a steel connection piece to be welded on the outer extremity of the tube 22 to pass over the bellows 26 to the flange 30. By pre-stressing the bellows in one direction and welding the connection piece to the flange before fitting the cooler to the furnace the total movement between the bellows 26 and the tube 22 can be allowed in the opposite direction to the pre-stressing. After fitting the cooler to the furnace the connection piece must be cut at one end to revert to a flexible condition. If the connection piece is fitted over the top of the bellows it also acts as a protection for the bellows.

In case the bellows fail a cap may readily be welded over the end of the tube 22 and to the flange making a rigid gas tight seal, the absence of flexibility being acceptable once the initial movement between the refractory lining and the shell has taken place.

In order to force the coolers tight into the refractory lining jacking bolts may be fitted to the steel flange 30 and these may be screwed in to apply pressure to the rear of the cooler.

I claim:

1. A cooling element for a furnace with a refractory lining comprising a body adapted to be inserted through a hole in the wall of said furnace and to lie within the refractory lining, said element having at least one projecting portion extending from said furnace and embodying at least two conduits, for passage of coolant to said body, an outwardly extending collar at the end of said projecting portion, a bellows surrounding said projecting portion and having a rear and a forward end, the rear end of said bellows being attached to said collar and the forward end of said bellows being adapted for attachment to the wall of said furnace.

2. The cooling element according to claim 1, wherein said bellows is welded directly to said collar.

3. The cooling element according to claim 1, wherein the said one end of said body is enlarged preventing said cooler from entirely entering the furnace.

4. The cooling element according to claim 1, wherein said projecting portion includes a flange forming part of said body and a tube attached at one end to said flange, the collar being fixed to said tube spaced from the end thereof attached to said body.

5. The cooling element according to claim 4, including conduit means attached to said inlet and outlet and extending longitudinally through said tube in communication with a supply and return of cooling fluid.

6. The cooling element according to claim 1, wherein said projecting portion includes a single flange through which pass the inlet and outlet conduits for passage of coolant to said body.

7. The cooling element according to claim 6, wherein the said single flange is offset to the side of the cooler body, the inlet conduit leading directly to a conduit passing round the part of the cooler body remote from the flange.

8. A furnace comprising a furnace shell and at least one cooling element according to any one of claims 1, 2, 3, 4 or 5, said cooling element being fitted through a hole in the wall of said furnace, said furnace having a retaining plate welded to said outer surface of the furnace wall to which said bellows is attached.

* * * * *